US007614959B1

(12) United States Patent
Gentile

(10) Patent No.: US 7,614,959 B1
(45) Date of Patent: Nov. 10, 2009

(54) HIGH IMPACT GAME BALL CONSTRUCTION METHOD AND DEVICE

(76) Inventor: Robert Gentile, 30 Wyman Rd., Billerica, MA (US) 01821

( * ) Notice: Subject to any disclaimer, the term of this patent is extended or adjusted under 35 U.S.C. 154(b) by 951 days.

(21) Appl. No.: 10/715,768

(22) Filed: Nov. 18, 2003

(51) Int. Cl.

| | |
|---|---|
| ***A63F 9/24*** | (2006.01) |
| ***A63F 13/00*** | (2006.01) |
| ***G06F 17/00*** | (2006.01) |
| ***G06F 19/00*** | (2006.01) |
| ***A63B 37/00*** | (2006.01) |
| ***A63B 57/00*** | (2006.01) |
| ***A63B 69/36*** | (2006.01) |

(52) U.S. Cl. ..... 473/131; 463/39; 463/30; 463/31; 463/35; 473/52; 473/351; 473/361; 473/367; 473/368; 473/370; 473/372

(58) Field of Classification Search ..... 463/3, 463/30, 31, 35, 39; 473/52, 131, 351, 361, 473/367, 368, 370, 372
See application file for complete search history.

(56) References Cited

U.S. PATENT DOCUMENTS

| | | | | |
|---|---|---|---|---|
| 2,020,484 | A | 11/1935 | Turner | |
| 3,426,121 | A * | 2/1969 | Faulkner | 264/250 |
| 3,580,575 | A | 5/1971 | Speeth | |
| 3,804,411 | A | 4/1974 | Hendry | |
| 4,448,418 | A | 5/1984 | McNeill | |
| 4,463,951 | A * | 8/1984 | Kumasaka et al. | 473/601 |
| 4,610,071 | A * | 9/1986 | Miller | 29/458 |
| 5,007,647 | A * | 4/1991 | Gulick | 473/200 |
| 5,066,011 | A * | 11/1991 | Dykstra et al. | 473/570 |
| 5,236,383 | A | 8/1993 | Connelly | |
| 5,388,825 | A * | 2/1995 | Myers et al. | 473/570 |
| 5,564,702 | A | 10/1996 | Meffert | |
| 5,725,445 | A | 3/1998 | Kennedy et al. | |
| 5,882,567 | A * | 3/1999 | Cavallaro et al. | 264/255 |
| 5,924,942 | A | 7/1999 | Gentile | |
| 6,042,487 | A * | 3/2000 | Schrimmer et al. | 473/353 |
| 6,117,030 | A * | 9/2000 | Green, Sr. | 473/570 |
| 6,422,960 | B1 * | 7/2002 | Touhey et al. | 473/593 |
| 2001/0002738 | A1 * | 6/2001 | Sullivan et al. | 264/279.1 |
| 2002/0173378 | A1 * | 11/2002 | Tinsman | 473/351 |
| 2003/0054905 | A1 * | 3/2003 | King, Jr. | 473/467 |
| 2005/0005873 | A1 * | 1/2005 | Gick | 119/707 |

* cited by examiner

*Primary Examiner*—John M Hotaling, II
*Assistant Examiner*—Adetokunbo Torimiro
(74) *Attorney, Agent, or Firm*—O'Connell Law Firm

(57) ABSTRACT

A high impact game ball with a core structure founded on a spherical member, a spherical casing concentrically disposed relative to the spherical member, at least one surface deviation disposed relative to the spherical member of the core structure, and at least one corresponding surface deviation disposed relative to the spherical casing in a mating relationship with the at least one surface deviation of the spherical member. A switching arrangement can be embedded in the spherical member for causing a response to be exhibited based on the occurrence of an activation condition, such as an impact or a remote activation signal. A plurality of positioning stays can project from the spherical member to ensure a concentric relationship relative to the spherical casing.

60 Claims, 4 Drawing Sheets

HIGH IMPACT GAME BALL CONSTRUCTION METHOD AND DEVICE

FIELD OF THE INVENTION

The present invention relates generally to game balls. More particularly, disclosed and protected by the present patent is a method for constructing a high impact game ball and the resulting game ball.

BACKGROUND OF THE INVENTION

The prior art has disclosed innumerable game ball constructions with a nearly endless variety of purposes and effects. However, one knowledgeable in the art will be well aware that there remains a need for a game ball that, where necessary, can withstand high impacts while retaining structural integrity and consistency in performance and while also providing enhanced performance benefits and functions.

SUMMARY

Advantageously, the present invention is founded on the most basic object of a game ball capable of withstanding high impacts while maintaining its structural integrity and while demonstrating consistent performance even after successive impacts relative to the game ball structure.

A further object of certain embodiments of the invention is to provide a high impact game ball capable of exhibiting an indication or signal in response to a given condition or set of conditions.

A more particular object of particular embodiments of the invention is to provide a high impact game ball that can trigger a light, sound, and/or electronic and/or any other indication or signal in response to an impact relative to the high impact game ball.

An additional or alternative object of certain embodiments of the invention is to provide a high impact game ball that can trigger a light, sound, and/or electronic and/or any other indication or signal in response to a remote activation by a user.

In certain cases, the invention can have the more particular object of providing a high impact game ball that can be activated by remote sound sources, electronic sources, and/or any other activating source that might be remotely imparted by a user.

A further object of embodiments of the invention is to provide a high impact game ball that can be activated for predetermined time periods and/or user-determined time periods.

These, and in all likelihood further, objects and advantages of the present invention will become obvious not only to one who reviews the present specification and drawings but also to those who have an opportunity to make use of an embodiment of the high impact game ball disclosed herein. However, it will be appreciated that, while the accomplishment of each of the foregoing objects in a single embodiment of the invention may be possible and indeed preferred, not all embodiments will seek or need to accomplish each and every potential advantage and function. Nonetheless, all such embodiments should be considered within the scope of the present invention.

In carrying forth the objects described above, an embodiment of the high impact game ball can be formed under a multi-stage process with one stage comprising an enveloping of a spherical member of a core structure within a spherical casing in a concentrically relationship. The spherical member of the core structure can have at least one surface deviation for engaging at least one corresponding surface deviation of the spherical casing in a mating relationship. The surface deviation disposed relative to the spherical member of the core structure can in certain cases take the form of a registration projection or protuberance and the surface deviation disposed relative to the spherical casing can comprise a registration indentation. The registration projection could, by way of example, comprise a metal post.

Most likely prior to its being enveloped within the spherical casing, the spherical member of the core structure can have a switching arrangement embedded therein. The switching arrangement can have a means for sensing an activation condition, a means for triggering a response upon an occurrence of the activation condition, and a means for exhibiting the response based on the occurrence of the activation condition. The means for sensing an activation condition can be caused to sense any possible activation condition including, for example, an impact relative to the high impact game ball or a remote activation signal.

The remote activation signal could comprise any effective signal that might now exist or hereafter be developed including, by way of example, an infrared activation signal or a sound signal. In any case, the means for exhibiting a response based on the occurrence of the activation condition can be a light source, a sound source, or any other source. With this, the high impact game ball can be caused to emit light, sound, or any other signal or indication automatically upon an impact relative to the game ball and/or upon a selective activation by a remote activation signal.

A concentric relationship between the spherical member of the core structure and the spherical casing can be ensured by the provision of a plurality of positioning stays projecting from the spherical member. The positioning stays can project by an amount substantially equal to a radial thickness of the spherical casing. In certain constructions, each of the plurality of positioning stays can comprise a generally rigid strand of material, such as metal, that projects radially from the spherical member of the core structure.

The multi-stage process can be carried forth with the spherical member of the core structure being injection molded, possibly with a switching arrangement disposed therein and possibly under a high pressure injection molding process. The spherical casing can also be formed by injection molding in a subsequent manufacturing stage. In another later stage of the manufacturing process, a spherical shell can be disposed to envelope the spherical casing and the core structure again possibly by means of an injection molding procedure. Where such a spherical shell is provided, it can have a plurality of interior surface deviations disposed thereon the spherical shell for engaging a plurality of corresponding exterior surface deviations disposed on the spherical casing. With this, relative movement between the spherical shell and the spherical casing can be further prevented.

The spherical member of the core structure can be formed, for example, from a polycarbonate resin, such as LEXAN, under a high pressure injection molding process. The spherical casing can be molded from a high density silicone under an injection molding process. Finally, the spherical shell can protect the spherical casing and the spherical member by being crafted from, by way of example, a high-impact, high-density polystyrene or similar material.

One will appreciate that the foregoing discussion broadly outlines the more important features of the invention to enable a better understanding of the detailed description that follows and to instill a better appreciation of the inventor's contribution to the art. Before any particular embodiment or aspect thereof is explained in detail, it must be made clear that the following details of construction, descriptions of hardware and software designs, and illustrations of inventive concepts are mere examples of the many possible manifestations of the invention.

DETAILED DESCRIPTION OF PREFERRED EMBODIMENTS

As is the case with many inventions, the present invention for a high impact game ball is subject to a wide variety of embodiments. However, to assure that one skilled in the art will be able to understand and, in appropriate cases, practice the present invention, certain preferred embodiments and aspects of preferred embodiments of the broader invention revealed herein are described below and shown in accompanying figures.

Figure 1:
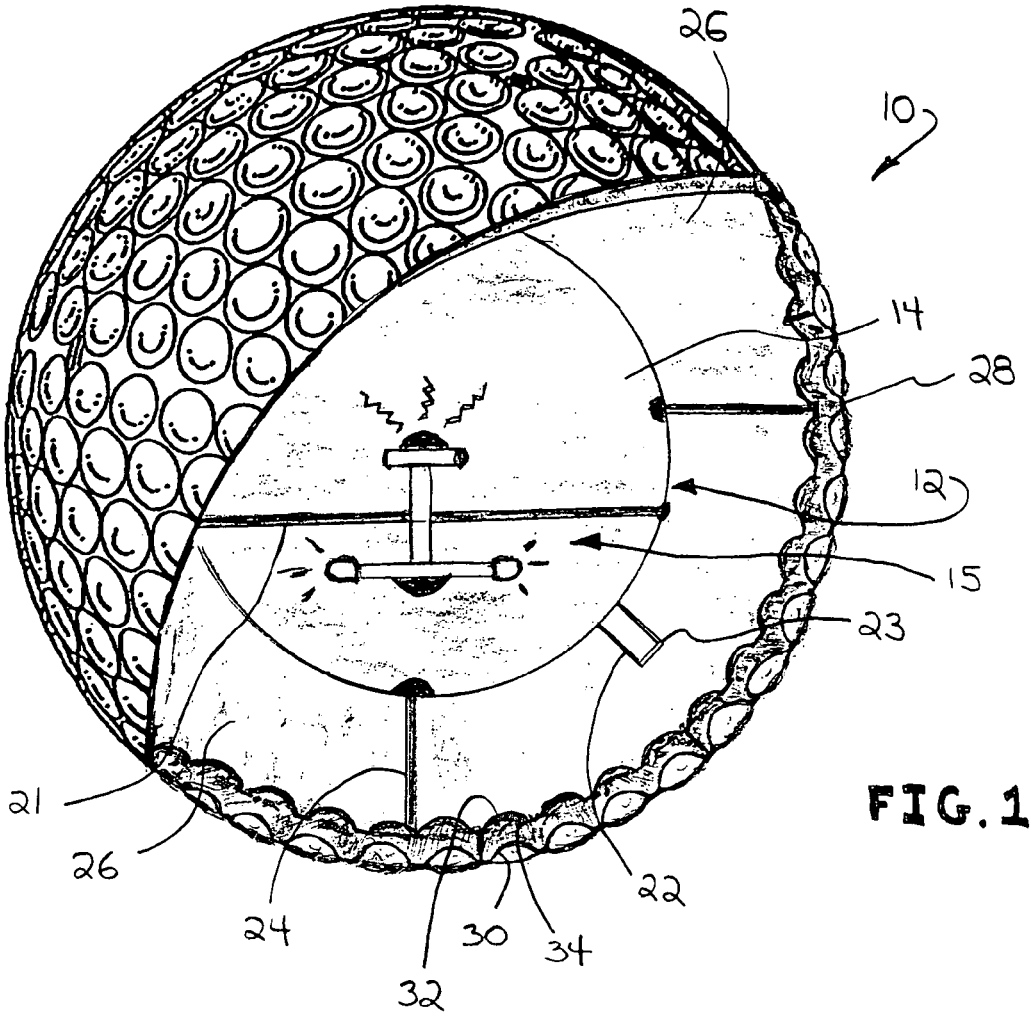
FIG. 1 is a view in partial cross section of a high impact game ball according to the present invention.
Figure 4:
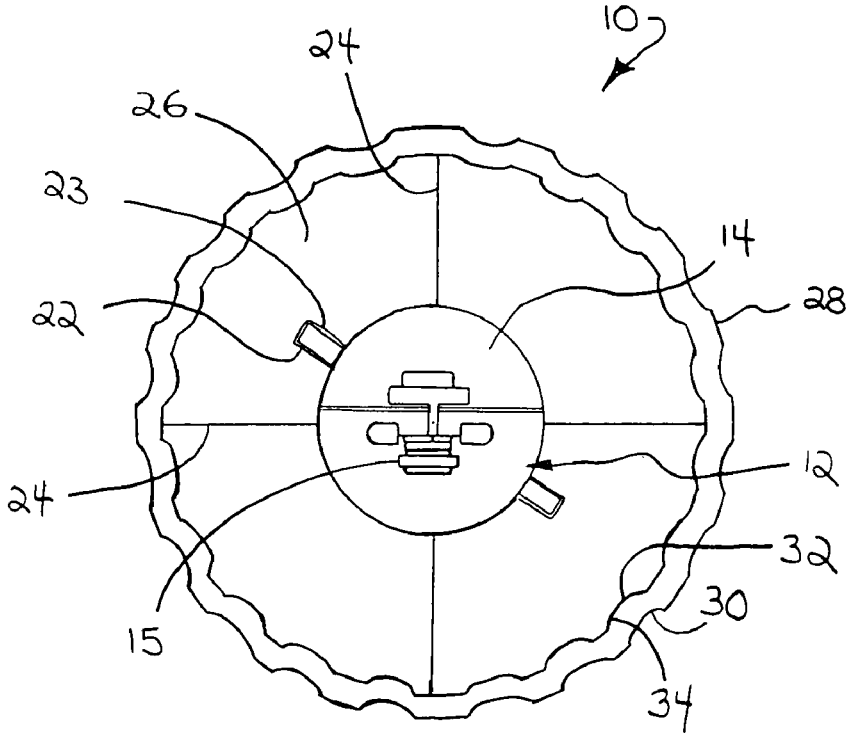
FIG. 4 is a cross sectional view in front elevation of the core structure and spherical casing encased within a spherical shell to form a high impact game ball according to the invention disclosed herein.
Figure 5:
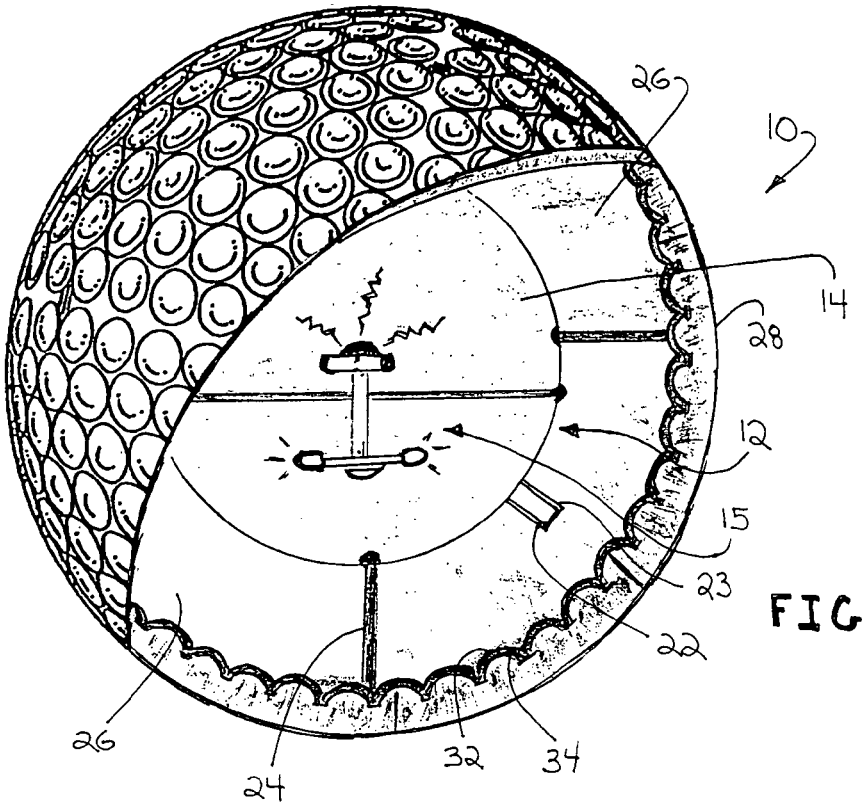
FIG. 5 is a view in partial cross section of an alternative high impact game ball according to the present invention.

Under the present invention, high impact game balls can be formed under a multi-step process that can produce a game ball, such as the game ball indicated generally at 10 in FIG. 1, 4, or 5 suitable for use in substantially any application. In certain embodiments, a game ball 10 according to the present invention can be particularly suitable with respect to applications involving impacts relative to the game ball 10, whether by impact between the game ball 10 and a striking implement, a person's body, or any other structure. As such, high impact game balls 10 as taught herein can be employed to great advantage in golf, street hockey, soccer, croquet, lacrosse, bocce, paddle ball, floor hockey, field hockey, baseball, volley ball, badminton, ping pong, simply ball play, and in any other application that might now exist or later be discovered. In any event, when constructed as described herein, the game ball 10 can withstand high impacts while maintaining a properly centered, shaped, and balanced structure.

Figure 2:
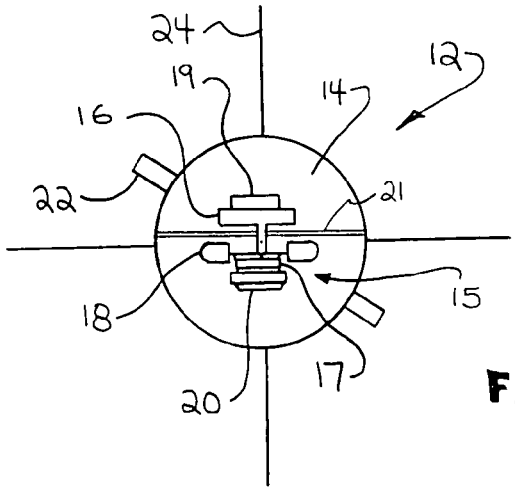
FIG. 2 is a cross sectional view in front elevation of a core structure for a high impact game ball according to the present invention.

Turning more particularly to the drawings, a cross section during a primary stage in the construction of a high impact game ball shown in FIG. 2. In this primary stage, a core structure 12 is provided. The core structure 12 is founded on a spherical member 14. In this exemplary embodiment, the spherical member 14 encases a switching arrangement 15. The switching arrangement 15 can include a switching mechanism 16, which can receive power from a power source 20, such as a battery. The switching mechanism 16 can activate one or more light sources 18, which can comprise LEDs or any other appropriate source. Additionally or alternatively, the switching mechanism 16 can activate a sound source 19, which can be located within the spherical member 14 or elsewhere within the game ball. The operation of the switching arrangement 15, the power source 20, the light sources 18, and the sound source 19 can, if necessary, be controlled by a microcontroller 17.

Figure 3:
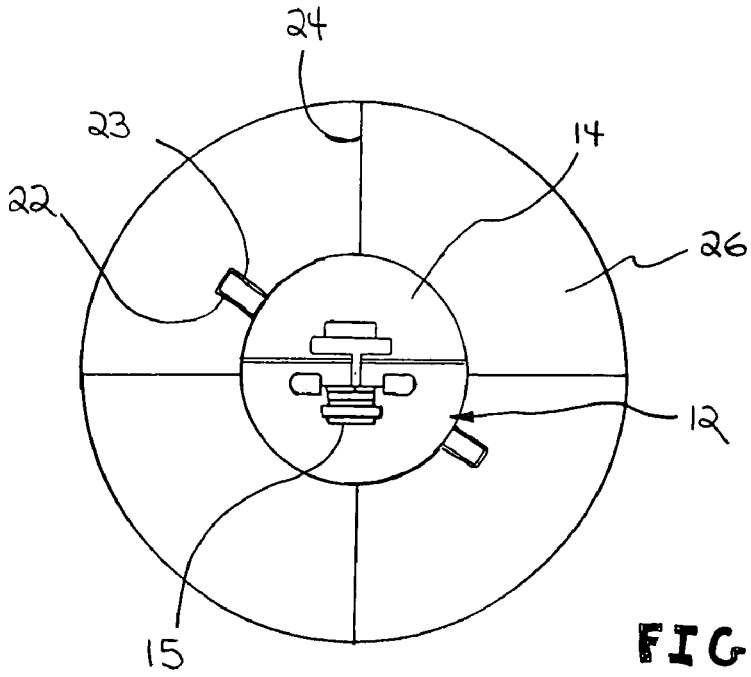
FIG. 3 is a cross sectional view in front elevation of the core structure of FIG. 2 enveloped within a spherical casing pursuant to the instant invention.

The spherical member 14 of the core structure 12 is concentrically disposed within a spherical casing 26 as is shown in FIG. 3. The spherical member 14 has a plurality of surface deviations, which in this case comprise registration projections 22, extending therefrom or disposed therewithin for engaging corresponding surface deviations, which in this case comprise registration indentations 23, and thereby assisting in preventing relative movement and maintaining accurate registration between the spherical member 14 and the spherical casing 26. The registration projections 22 can take any effective form including, by way of example and not limitation, rounded protuberances, spikes, the posts depicted in the exemplary embodiments of the accompanying drawings, and any other protuberance, extension, or other projection. When so formed, the registration projections 22 can be crafted from any appropriate material including, by way of example, metal, ceramic, plastic, wood, glass, any combination thereof, or any other material. The surface deviations could alternatively comprise indentations into the spherical member 14. In such a case, the spherical casing 26 can have corresponding and mating surface deviations, such as projections extending into the indentations in the spherical member 14.

In this embodiment, the spherical member 14 additionally has a plurality of positioning stays 24 extending therefrom for ensuring a concentric formation of the casing 26 relative to the spherical member 14. As such, the positioning stays 24 in this example project from the spherical member 14 identical distances. With this, the spherical member 14 can be disposed within a spherical mold cavity during, by way of example, an injection molding process and maintained in a precisely concentric relationship relative to the mold cavity by the positioning stays 24 by the contact of their distal ends with the spherical inner surface of the mold cavity. With that, the casing 26 will be formed in a precisely concentric relationship relative to the spherical member 14. In a similar manner relative to the core structure 12, the switching arrangement 15 can be retained in proper position during formation of the spherical member 14 by one or more positioning stays 21.

It will be appreciated, of course, that it could be possible in certain embodiments to have single members function both as registration projections 22 and positioning stays 24. It is also within the scope of the invention to have the positioning stays 24 provided only to maintain the spherical member 14 in place during the formation of the casing 26 and then either to be removed, to melt or merge with the material of the casing 26, or to otherwise no longer be associated with the high impact game ball 10. The positioning stays 24 could be formed from any functional material including, by way of example, metal, ceramic, plastic, wood, glass, or any other material or combination thereof.

With the core structure 12 and the casing 26 so formed, the unified structure can in certain embodiments be further enveloped within a spherical shell 28 as is shown in FIGS. 1, 4, and 5. The shell 28 can act as a protective skin around the casing 26 and the core structure 12 and can be applied under any of the plurality of appropriate methods that would readily occur to one skilled in the art after reading this disclosure. Under one embodiment, the shell 28 can be formed by injection molding.

As FIG. 5 shows, the shell 28 can have a smooth exterior surface. Alternatively, as is shown in FIGS. 1 and 4, the shell 28 can have a plurality of exterior surface deviations 30 formed therein. The exterior surface deviations 30 can comprise protuberances, indentations, or both. As such, the exterior surface deviations 30 can be employed to affect the performance and handling characteristics of the resulting high impact game ball 10. In this example, the exterior surface deviations 30 comprise dimples spaced over the entire periphery of the shell 28 that can be employed to enhance the aerodynamic characteristics of the game ball 10.

The shell 28 can additionally or alternatively have a plurality of interior surface deviations 32 formed therein as is the case in the embodiments of each of FIGS. 1, 4, and 5. As with the exterior surface deviations 30, the interior surface deviations 32 can comprise protuberances beyond the spherical inner surface of the shell 28, indentations into that spherical surface, or both. The interior surface deviations 32 can operate to prevent relative movement of the shell 28 relative to the casing 26, including during impact situations.

The registration function of the interior surface deviations 32 can be enhanced by corresponding casing surface deviations 34 disposed relative to the peripheral surface of the casing 26. The casing surface deviations 34 can be formed in a number of ways. The casing surface deviations 34 could be molded or otherwise cast during the formation of the casing 26. Alternatively, the casing surface deviations 34 could be induced during the formation of the shell 28, such as during the injection molding of the shell 28. Still further, the casing surface deviations 34, the interior surface deviations 32, and the exterior surface deviations 30 could possibly be formed in a single process, such as by the application of selective pressure or a stamping process to the periphery of the shell 28 to induce an essentially simultaneous formation of the exterior surface deviations 30, the interior surface deviations 32, and the casing surface deviations 34.

Material selection for the components of the game ball 10 will, of course, depend at least to a certain extent on the projected application to which the game ball 10 will be put. Under one construction of the high impact game ball 10, the spherical member 14 of the core structure 12 can be formed from in what can be considered a first stage of the manufacturing process of a high impact, 'unbreakable' plastic, such as a polycarbonate resin. One presently contemplated polycarbonate resin is that sold under the trademark LEXAN by the General Electric Company. The polycarbonate resin can be formed into the core structure 12 under an injection molding process that can be carried out at high pressure, such as in the 1,000 to 10,000 psi range, with the switching arrangement 15, the registration projections 22, and the positioning stays 24 embedded therein or subsequently inserted or otherwise applied.

The casing 26 can be formed in what can be termed a second stage of the manufacturing process from a high density silicone or silicone-based material or a high-density, high-impact plastic resin. The casing 26 can be injection molded and allowed to cure with the core structure 12, the registration projections 22, and the positioning stays 24 embedded therein. With that, the casing 26 and the core structure 12 will effectively form a single unit with no potential for relative movement therebetween.

Finally, the protective spherical shell 28 can be applied, such as by injection molding, to envelope the core structure 12 and the casing 26 in what can be deemed a third stage of the manufacturing process. The shell 28 can be formed of any suitable material including, by way of example, a high-impact, high-density polystyrene plastic. The exterior surface deviations 30, the interior surface deviations 32, and the casing surface deviations 34 can be formed as described previously. The resulting high impact game ball 10 can be employed as a single unit and can withstand the high impacts of substantially any application with no relative displacement between the core structure 12, the casing 26, or the shell 28.

Where injection molding is employed to form the spherical member 14, the casing 26, and/or the shell 28, the relevant structure can be formed by the injection of liquid material under high heat and pressure that can then be rendered solid by allowing to cool passively. Alternatively, the liquid material can be cured by an active cooling method, such as by the application of sub-freezing temperatures. Under one method, for example, the mold for the spherical member 14, the casing 26, and/or the shell 28 can be encased within a cooling jacket through which a cooling liquid or gas can be passed in a manner similar to many motor cooling arrangements.

It will be appreciated, of course, that the description of the formation of the high impact game ball 10 in terms of a three-stage manufacturing process presupposes the formation of the switching arrangement 15 with the switching mechanism 16, the power source 20, any light sources 18, any sound source 19, and any necessary microcontroller 17. By means that would be readily within the ability of one skilled in the art based on the knowledge provided by this disclosure, the switching arrangement 15 can activate the light sources 18, the sound source 19, and/or any other type of indicator mechanism, signaling mechanism, or other mechanism in response to any one of a number of conditions including, by way of example, an impact relative to the game ball 10, a remote activation by a user, or any other condition.

Under one embodiment, the switching arrangement 15 can include an infrared or other wireless activation mechanism such that a user can trigger the switching arrangement 15 remotely, such as by an infrared signal. Once triggered, the switching arrangement 15 can induce the light sources 18, the sound source 19, and/or any other indication or signal mechanism into operation. Such an activation can be used to any end including, by way of example, for simple play or display purposes or to enable a user to locate a high impact game ball 10 that has been lost or otherwise misplaced. Additionally or alternatively, the switching mechanism 15 could be sound activated by means well known to the art. With this, a user can induce a triggering of the switching arrangement 15 by exposing the high impact game ball 10 to a predetermined sound or pattern of sounds, such as a whistling, clapping, or any other sound or pattern of sounds. The activated mechanism, whether the light sources 18, the sound source 19, or any other indicator or signal, can be activated for predetermined time periods and/or user-determined time periods, such as for a number of seconds or minutes or infinitely until a further triggering of the switching arrangement 15.

Figure 6:
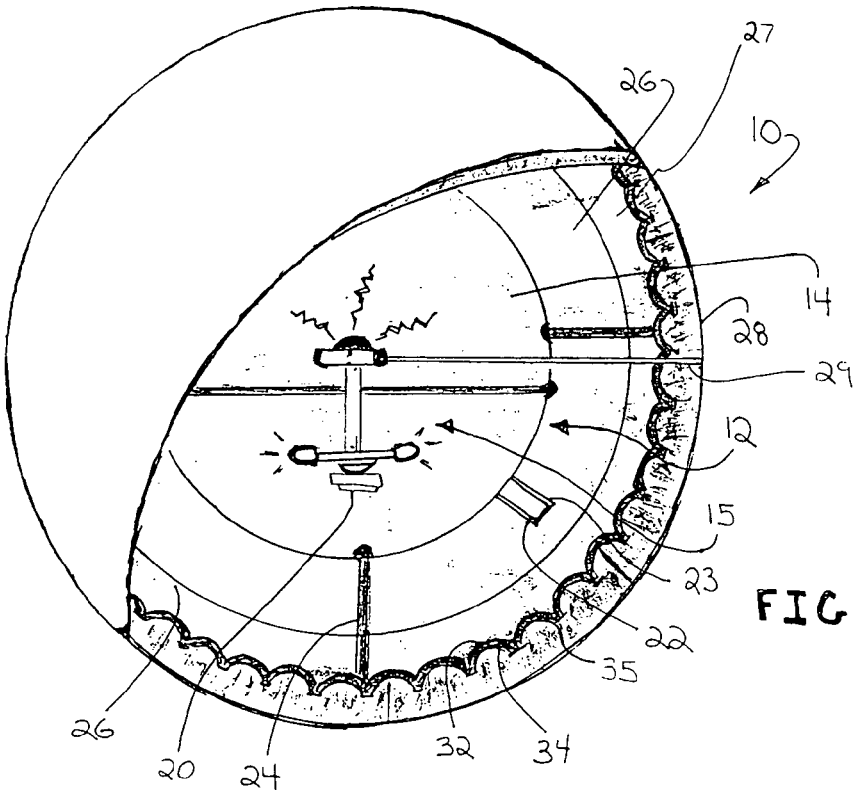
FIG. 6 is a view in partial cross section of a further alternative high impact game ball according to the present invention.

In FIG. 6, a further embodiment of the high impact game ball 10 is depicted and again has a core structure 12, a casing 26, and a shell 28. The exemplary high impact game ball 10 in this embodiment, however, further includes a lightweight spherical layer 27, which may be a sub-layer as shown in FIG. 6 or an outer layer. The lightweight spherical layer 27 can be formed from any lightweight material, which will preferably have a specific gravity of less than 1. In certain embodiments, the composition and geometry of the lightweight spherical layer 27 can be calibrated based on the composition and geometry of the remainder of the high impact game ball 10 to cause the overall high impact game ball 10 to have a specific gravity of not greater than, preferably less than, 1 such that the high impact game ball 10 will tend to float. Such a characteristic can be advantageous in applications in which the high impact game ball 10 might otherwise sink and potentially be lost during use.

While it will again be noted that the material or materials employed for forming the lightweight spherical layer 27 can vary widely based on the above-described parameters, one presently contemplated material is aerogel, which has been deemed the lightest solid in the world. Aerogel, commonly referred to as frozen smoke based on its appearance, can weigh just 0.00011 lb/in$^3$. The silicon-based solid has a nanoporous, sponge-like structure with approximately 99.8 percent empty space. As such, aerogel would be advantageous in forming a high impact game ball 10 with a desirably low specific gravity.

Figure 7:
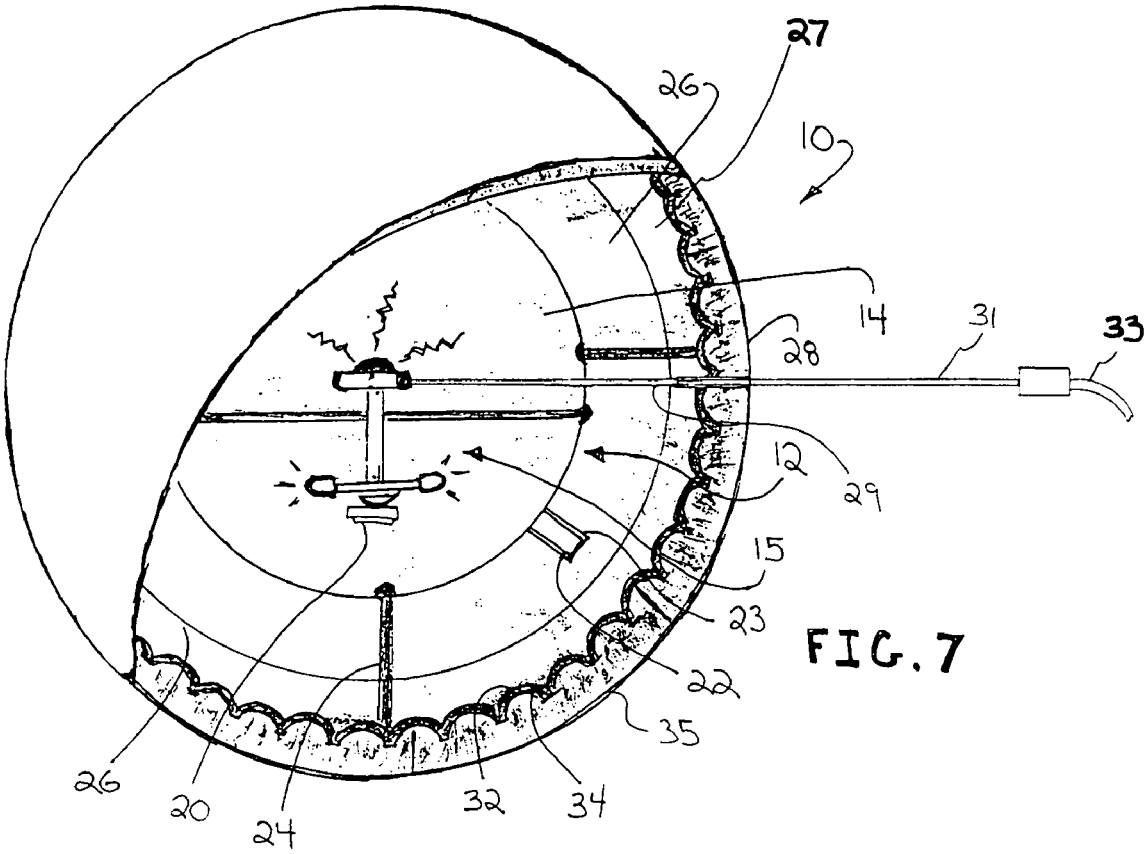
FIG. 7 is a view in partial cross section of yet another embodiment of the high impact game ball.

The high impact game balls 10 of FIGS. 6 and 7 further include a luminescent layer 35 such that the high impact game ball 10 can emit light in addition or alternatively to that emitted by the light source or sources 18. For example, the luminescent layer 35 could emit light between flashes of the light sources 18, after the light sources 18 have ceased flashing or otherwise emitting light, and/or when the light sources 18 are non-existent, inactivated, or inoperative. In FIG. 6, the luminescent layer 35 resides between the lightweight spherical layer 27 and the shell 28 while the luminescent layer 35 is applied to the exterior surface of the shell 28 in the embodiment of FIG. 7.

The luminescent layer 35 can be any appropriate material. In one embodiment, the luminescent layer 35 can be formed by a phosphorescent material such that it would absorb incident light at one wavelength and then emit visible light at a different wavelength for a noticeable time including after the cessation of the incident light. Alternatively, the luminescent layer 35 could be chemiluminescent, bioluminescent, or any other suitable light emitting material. The luminescent layer 35 could be applied in any form, including as a powder, a crystalline composition, a pigment, a paint, and any other possible form. The luminescent layer 35 can comprise a distinct layer. Additionally or alternatively, the luminescent layer 35 could be incorporated into any of the core structure 12, the casing 26, and/or the shell 28 as by being intermixed with the predominant material of the respective layer.

The embodiments of FIGS. 6 and 7 depict a further potential refinement of the invention in the form of an access conduit 29 that traverses from the switching arrangement 15 to the exterior of the high impact game ball 10. The access conduit 29 enables controlled access to the switching arrangement 15 and the components thereof from the exterior of the high impact game ball 10 by use of an elongate probe 31 that can be selectively inserted into the access conduit 29 to achieve contact with the switching arrangement 15. The access conduit 29 can incorporate a means for sealing the access conduit 29 to prevent or at least minimize the entry of debris, liquids, and other materials. The means for sealing the access conduit 29 could take any suitable form. In one embodiment, the means for sealing the access conduit 29 can simply be based on a the construction of the access conduit 29 itself in combination with the materials forming the core structure 12, the casing 26, and/or the shell 28. More particularly, the size and shape of at least a portion of the access conduit 29 can be calibrated based on the resiliency of the surrounding material to result in an at least partial sealing off of at least part of the access conduit 29 when the elongate probe 31 is not received therein. With this, the access conduit 29 can be normally sealed and can be opened only by a sliding of the elongate probe 31 therethrough. Other sealing arrangements are, of course, possible and within the scope of the present invention.

In certain embodiments, the access conduit 29 can be crafted to enable the elongate probe 31 to reach and selectively operate a switching mechanism 16 of the switching arrangement 15 such that a user could mechanically activate or deactivate the high impact game ball 10 with regard to any available function, such as the emission of constant or intermittent light, sound, electronic, and other signals. In further embodiments, the elongate probe 31 and the access conduit 29 can additionally or alternatively be employed to enable a charging or recharging of the power source 20 by use of any appropriate source of exterior power, which in the example of FIG. 7 comprises a power cord 33.

With a plurality of exemplary embodiments and details of the present invention for a wireless information retrieval and content dissemination system and method disclosed, it will be appreciated by one skilled in the art that numerous changes and additions could be made thereto without deviating from the spirit or scope of the invention. This is particularly true when one bears in mind that the presently preferred embodiments merely exemplify the broader invention revealed herein. Accordingly, it will be clear that those with major features of the invention in mind could craft embodiments that incorporate those major features while not incorporating all of the features included in the preferred embodiments.

Therefore, the following claims are intended to define the scope of protection to be afforded to the inventor. Those claims shall be deemed to include equivalent constructions insofar as they do not depart from the spirit and scope of the invention. It must be further noted that a plurality of the following claims express certain elements as means for performing a specific function, at times without the recital of structure or material. As the law demands, these claims shall be construed to cover not only the corresponding structure and material expressly described in this specification but also all equivalents thereof.

I claim as deserving the protection of Letters Patent:

1. A high impact game ball comprising:

a core structure comprising a spherical member with an outer surface;

a spherical casing concentrically disposed to envelop the spherical member of the core structure wherein the spherical casing has an inner surface and an outer surface wherein the outer surface of the spherical member and the inner surface of the spherical casing are in direct contact over substantially the entire outer surface of the spherical member and the inner surface of the spherical casing;

a plurality of surface deviations disposed relative to the outer surface of the spherical member of the core structure;

a plurality of corresponding, interlocking surface deviations disposed relative to the inner surface of the spherical casing in a mating relationship with the plurality of surface deviations disposed relative to the spherical member of the core structure whereby the plurality of surface deviations and the plurality of corresponding surface deviations are interposed between the spherical member of the core structure and the spherical casing.

2. The high impact game ball of claim 1 wherein at least one of the plurality of surface deviations disposed relative to the spherical member of the core structure comprises a rigid registration projection and wherein at least one of the plurality of surface deviations disposed relative to the spherical casing comprises a registration indentation that corresponds to the registration projection.

3. The high impact game ball of claim 1 further comprising a switching arrangement embedded in the spherical member of the core structure wherein the switching arrangement comprises a means for sensing an activation condition relative to the switching arrangement, a means for triggering a response upon an occurrence of the activation condition, and a means for exhibiting the response based on the occurrence of the activation condition.

4. The high impact game ball of claim 1 further comprising a plurality of positioning stays wherein each positioning stay has a proximal end coupled to the spherical member of the core structure, a body portion, and a distal end and wherein each positioning stay projects from the spherical member of the core structure an amount substantially equal to a radial thickness of the spherical casing whereby the plurality of positioning stays can ensure a concentric relationship between the spherical member of the core structure and the spherical casing.

5. The high impact game ball of claim 1 further comprising a spherical shell disposed to envelope the spherical casing and the core structure wherein the spherical shell has an inner surface and an outer surface wherein the outer surface of the spherical casing and the inner surface of the spherical shell are in direct contact over substantially the entire outer surface of the spherical casing and the inner surface of the spherical shell.

6. The high impact game ball of claim 1 further comprising a lightweight spherical layer with a specific gravity of less than 1.

7. The high impact game ball of claim 1 further comprising a luminescent layer for enabling the high impact game ball to emit light.

8. The high impact game ball of claim 2 wherein the registration projection comprises a rigid post that projects from the spherical member of the core structure and into the registration indentation of the spherical casing.

9. The high impact game ball of claim 2 wherein there are a plurality of rigid registration projections that project from the spherical member of the core structure and into corresponding registration indentations of the spherical casing.

10. The high impact game ball of claim 3 wherein the means for sensing an activation condition comprises a means for sensing an impact relative to the high impact game ball.

11. The high impact game ball of claim 3 wherein the means for sensing an activation condition comprises a means for sensing a remote activation signal whereby the response can be caused to be exhibited by a remote activation signal.

12. The high impact game ball of claim 3 further comprising an access conduit with a proximal end adjacent to the switching arrangement and a distal end in communication with an exterior surface of the high impact game ball.

13. The high impact game ball of claim 4 wherein each of the plurality of positioning stays comprises a generally rigid strand of material that projects radially from the spherical member of the core structure.

14. The high impact game ball of claim 5 further comprising a plurality of interior surface deviations disposed on the inner surface of the spherical shell and a plurality of corresponding exterior surface deviations disposed on the outer surface of the spherical casing whereby relative movement between the spherical shell and the spherical casing is prevented.

15. The high impact game ball of claim 5 wherein the spherical member of the core structure is formed from a polycarbonate resin under a high pressure injection molding process, wherein the spherical casing is formed from a high density silicone under an injection molding process, and wherein the spherical shell is formed under an injection molding process.

16. The high impact game ball of claim 6 wherein the high impact game ball has a specific gravity of not greater than 1.

17. The high impact game ball of claim 6 wherein the lightweight spherical layer comprises an aerogel.

18. The high impact game ball of claim 7 wherein the luminescent layer comprises a sub-layer.

19. The high impact game ball of claim 7 wherein the luminescent layer comprises an outer layer.

20. The high impact game ball of claim 9 wherein each of the plurality of registration projections comprises a metal post.

21. The high impact game ball of claim 10 wherein the means for exhibiting a response based on the occurrence of the activation condition comprises a light source for being activated in response to an impact relative to the high impact game ball wherein the light source is activated repeatedly for a pre-determined time period after the impact.

22. The high impact game ball of claim 10 wherein the means for exhibiting a response based on the occurrence of the activation condition comprises a sound source for being activated in response to an impact relative to the high impact game ball wherein the sound source is activated for a pre-determined time period after the impact.

23. The high impact game ball of claim 11 wherein the means for sensing an activation condition comprises a means for sensing an infrared activation signal.

24. The high impact game ball of claim 11 wherein the means for sensing an activation condition comprises a means for sensing a sound signal.

25. The high impact game ball of claim 11 wherein the means for exhibiting a response based on the occurrence of the activation condition comprises a light source for being activated in response to a remote activation signal.

26. The high impact game ball of claim 11 wherein the means for exhibiting a response based on the occurrence of the activation condition comprises a sound source for being activated in response to a remote activation signal.

27. The high impact game ball of claim 12 wherein the means for sensing an activation condition relative to the switching arrangement comprises a switch disposed adjacent to the proximal end of the access conduit.

28. The high impact game ball of claim 12 further comprising an elongate probe adapted to be received into the access conduit and a means for passing power through the elongate probe from exterior to the high impact game ball to the switching arrangement interior to the high impact game ball whereby the elongate probe can be employed to provide power to the switching arrangement from exterior to the high impact game ball.

29. The high impact game ball of claim 13 wherein the spherical casing is formed by injection molding.

30. The high impact game ball of claim 14 wherein the spherical shell has a generally smooth exterior surface.

31. The high impact game ball of claim 14 further comprising a plurality of exterior surface deviations disposed on the spherical shell.

32. The high impact game ball of claim 27 further comprising an elongate probe adapted to be received into the access conduit for triggering the switch of the switching arrangement whereby the elongate probe can be employed to induce an activation condition.

33. A game ball comprising:

a spherical member;

a switching arrangement embedded in the spherical member wherein the switching arrangement comprises a means for sensing an activation condition relative to the switching arrangement, a means for triggering a response upon an occurrence of the activation condition, and a means for exhibiting the response based on the occurrence of the activation condition;

an access conduit with a proximal end adjacent to the switching arrangement and a distal end in communication with an exterior surface of the game ball;

an elongate probe adapted to be received into the access conduit; and a means for passing power through the elongate probe from exterior to the high impact game ball to the switching arrangement interior to the high impact game ball whereby the elongate probe can be employed to provide power to the switching arrangement from exterior to the high impact game ball.

34. The game ball of claim 33 wherein the means for sensing an activation condition relative to the switching arrangement comprises a switch disposed adjacent to the proximal end of the access conduit wherein the switch can be activated by the elongate probe to induce an activation condition.

35. The game ball of claim 33 wherein the switching arrangement further comprises a rechargeable means for retaining power whereby the elongate probe and the means for passing power through the elongate probe can be employed to recharge the means for retaining power.

36. The game ball of claim 33 further comprising a lightweight spherical layer that envelopes the spherical member wherein the lightweight spherical layer has a specific gravity of less than 1.

37. The game ball of claim 33 further comprising a luminescent layer that envelopes the spherical member for enabling the game ball to emit light.

38. The game ball of claim 33 wherein the means for sensing an activation condition comprises a means for sensing an impact relative to the game ball.

39. The game ball of claim 33 wherein the means for exhibiting a response based on the occurrence of the activation condition comprises a sound source for being activated in response to an activation condition.

40. The game ball of claim 33 wherein the means for sensing an activation condition comprises a means for sensing a remote infrared activation signal whereby the response can be caused to be exhibited by a remote infrared activation signal.

41. The game ball of claim 33 wherein the means for sensing an activation condition comprises a means for sensing a sound signal.

42. The game ball of claim 36 wherein the game ball has a specific gravity of not greater than 1.

43. The game ball of claim 36 wherein the lightweight spherical layer comprises an aerogel.

44. The game ball of claim 38 wherein the means for exhibiting a response based on the occurrence of the activation condition comprises a light source for being activated in response to an impact relative to the game ball.

45. A method for constructing a high impact game ball comprising the following steps:

forming a spherical member to form a core structure wherein the spherical member has an outer surface;

forming a spherical casing to envelop the spherical member of the core structure in a concentric relationship wherein the spherical casing has an inner surface and an outer surface wherein the outer surface of the spherical member and the inner surface of the spherical casing are formed in direct contact over substantially the entire outer surface of the spherical member and the inner surface of the spherical casing;

forming a plurality of surface deviations relative to the outer surface of the spherical member of the core structure;

forming a plurality of corresponding, interlocking surface deviations relative to the inner surface of the spherical casing wherein the a plurality of corresponding surface deviations relative to the spherical casing is disposed in a mating relationship with the plurality of surface deviations disposed relative to the spherical member of the core structure whereby the plurality of surface deviations and the plurality of corresponding surface deviations are interposed between the spherical member of the core structure and the spherical casing.

46. The method of claim 45 wherein the step of forming a spherical casing is carried out in an injection molding process and includes cooling the spherical casing by an active cooling method.

47. The method of claim 45 wherein the step of forming a plurality of surface deviations relative to the spherical member of the core structure comprises forming a rigid registration projection and wherein the step of forming a plurality of corresponding surface deviations disposed relative to the spherical casing comprises forming a registration indentation that corresponds to the rigid registration projection.

48. The method of claim 45 further comprising the step of embedding a switching arrangement in the spherical member of the core structure wherein the switching arrangement comprises a means for sensing an activation condition relative to the switching arrangement, a means for triggering a response upon an occurrence of the activation condition, and a means for exhibiting the response based on the occurrence of the activation condition.

49. The method of claim 45 further comprising the step of disposing a plurality of positioning stays projecting from the spherical member of the core structure wherein each positioning stay has a proximal end coupled to the spherical member of the core structure, a body portion, and a distal end and wherein each positioning stay projects an amount substantially equal to a radial thickness of the spherical casing wherein the step of disposing the plurality of positioning stays occurs before the step of molding the spherical casing whereby the plurality of positioning stays ensure a concentric relationship between the spherical member of the core structure and the spherical casing.

50. The method of claim 45 further comprising the step of forming a spherical shell disposed to envelope the spherical casing and the core structure wherein the spherical shell has an inner surface and an outer surface wherein the outer surface of the spherical casing and the inner surface of the spherical shell are formed in direct contact over substantially the entire outer surface of the spherical casing and the inner surface of the spherical shell.

51. The method of claim 45 further comprising the step of forming a lightweight spherical layer of the high impact game ball with a specific gravity of less than 1.

52. The method of claim 45 further comprising the step of forming a luminescent layer for enabling the high impact game ball to emit light.

53. The method of claim 48 wherein the means for sensing an activation condition comprises a means for sensing a remote infrared activation signal whereby the response can be caused to be exhibited by a remote infrared activation signal.

54. The method of claim 48 wherein the means for sensing an activation condition comprises a means for sensing a sound signal.

55. The method of claim 48 further comprising the step of forming an access conduit with a proximal end adjacent to the switching arrangement and a distal end in communication with an exterior surface of the game ball.

56. The method of claim 50 further comprising the step of forming a plurality of interior surface deviations relative to the inner surface of the spherical shell and a plurality of corresponding exterior surface deviations relative to the exterior surface of the spherical casing whereby relative movement between the spherical shell and the spherical casing is prevented.

57. The method of claim 50 wherein the spherical member is formed form a polycarbonate resin under a high pressure injection molding process, wherein the spherical casing is formed from a high density silicone under an injection molding process, and wherein the spherical shell is formed under an injection molding process.

58. The method of claim 55 wherein the means for sensing an activation condition relative to the switching arrangement comprises a switch disposed adjacent to the proximal end of the access conduit.

59. The method of claim 55 further comprising the steps of providing an elongate probe adapted to be received into the access conduit and a means for passing power through the elongate probe from exterior to the high impact game ball to the switching arrangement interior to the high impact game ball whereby the elongate probe can be employed to provide power to the switching arrangement from exterior to the high impact game ball.

60. The method of claim 58 further comprising the step of providing an elongate probe adapted to be received into the access conduit for triggering the switch of the switching arrangement whereby the elongate probe can be employed to induce an activation condition.

* * * * *